United States Patent [19]

Paz

[11] Patent Number: 4,660,339

[45] Date of Patent: Apr. 28, 1987

[54] WALL SYSTEM

[76] Inventor: Felix Paz, 256 Greenway Rd., Lido Beach, N.Y. 11561

[21] Appl. No.: 799,920

[22] Filed: Nov. 20, 1985

[51] Int. Cl.[4] ..... E04H 1/00

[52] U.S. Cl. ..... 52/238.1; 52/266; 52/460; 52/348; 52/476

[58] Field of Search ..... 52/238.1, 266, 474, 52/460, 36, 27, 262, 664, 348, 464, 461, 243, 235, 476, 483, 490, 764, 489

[56] References Cited

U.S. PATENT DOCUMENTS 3,251,168 5/1966 Waring et al. ..... 52/461 X 3,571,987 3/1971 Anderson ..... 52/27

*Primary Examiner*—Carl D. Friedman

*Assistant Examiner*—Naoko N. Slack

*Attorney, Agent, or Firm*—Ostrolenk, Faber, Gerb & Soffen

[57] ABSTRACT

A wall system includes a grid constructed of horizontal main support channels mounted on a fixed wall and a plurality of spaced vertical standards secured to the channels at the front thereof. Each channel has a U-shaped cross-section with rearwardly extending arms diverging slightly so that overlapping channels may nest, one in the other. Ears projecting outward from the ends of the arms and lie in a common plane are used for securing the channel in place. The web of each channel is provided with a longitudinally extending row of equally spaced apertures. Each standard is provided with two longitudinally extending rows of holes with the rows being spaced by the distance between apertures and the holes in opposite rows being connected by lines that are perpendicular to the longitudinal axis of the standard. Fasteners extending through holes in each row are received by adjacent apertures in the channel web to automatically secure the standard in a position at right angles to the support channel.

29 Claims, 27 Drawing Figures

FIG. 9A.
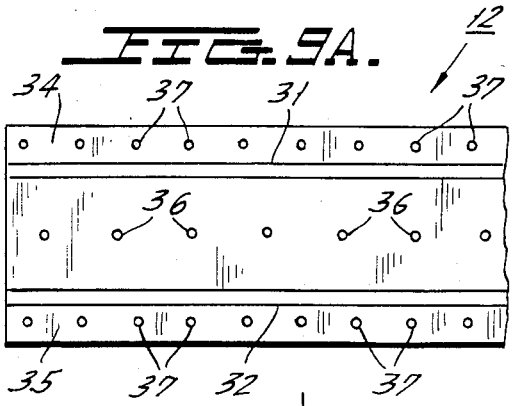
FIG. 9.
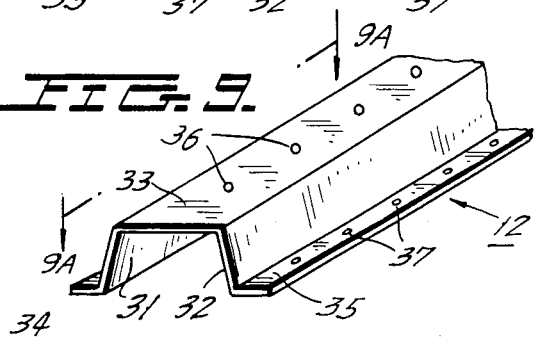
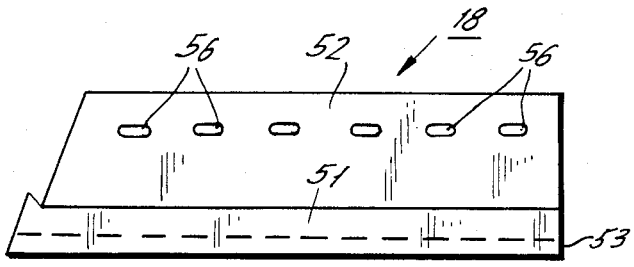
FIG. 8A.
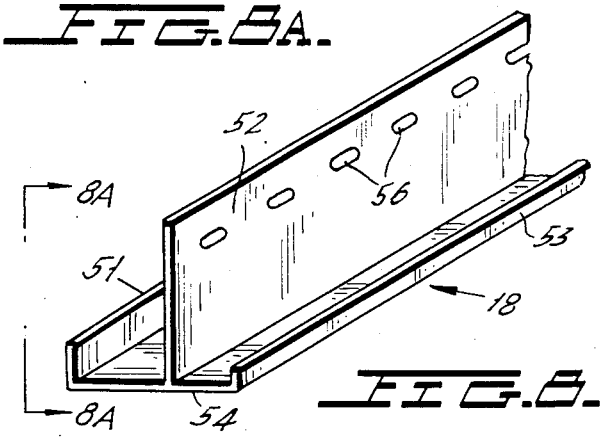
FIG. 8.
FIG. 3.
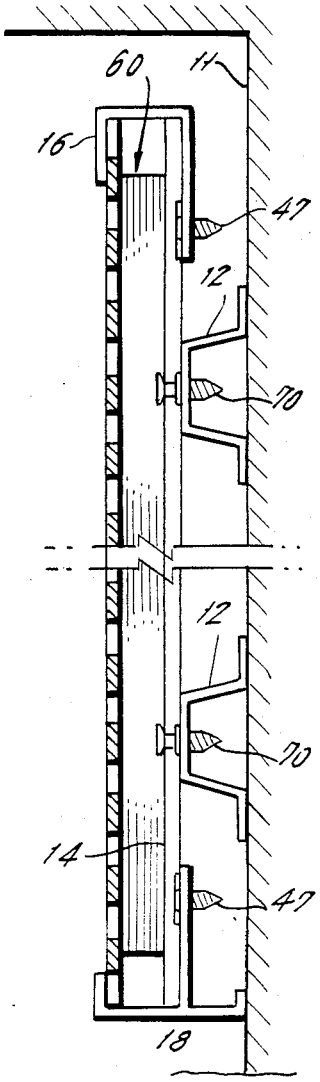

FIG. 12.
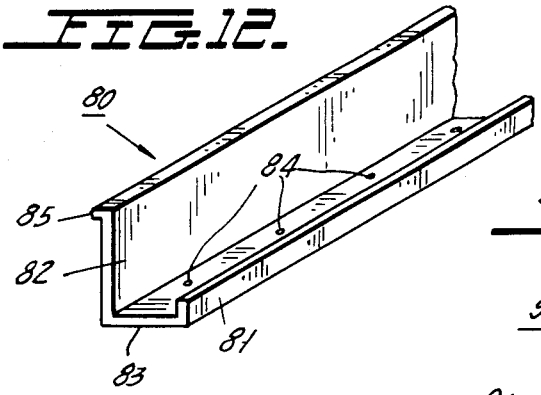
FIG. 13.
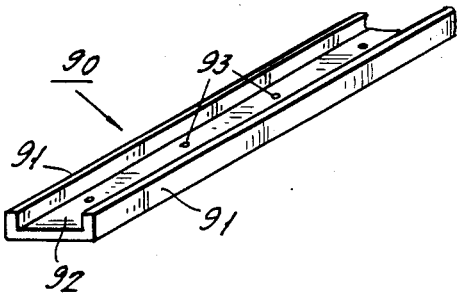
FIG. 18.
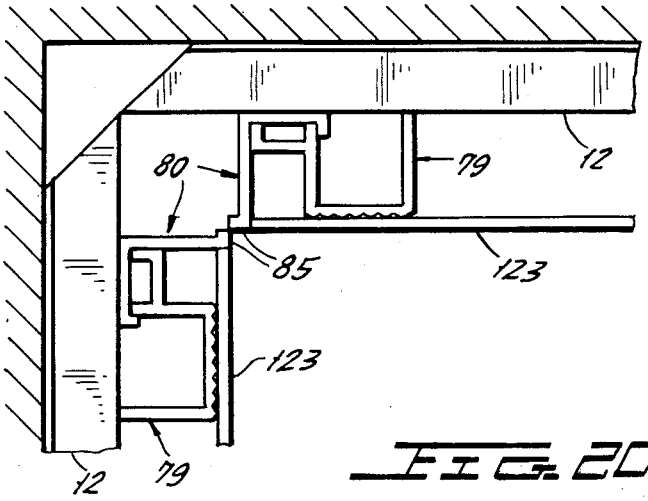
FIG. 20B.
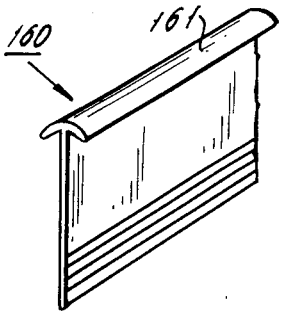
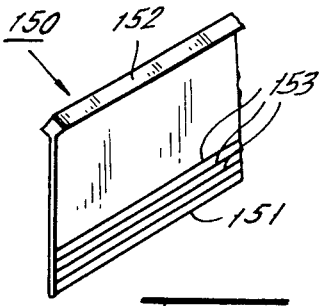
FIG. 20A.

WALL SYSTEM

BACKGROUND OF THE INVENTION

This invention relates to wall systems in general and more particularly relates to wall systems having readily removable and replaceable panels and display elements.

In restaurants, offices, retail stores and merchandise showrooms, the trend is to make major changes in wall surfacing and/or displays during the course of the year because of seasonal changes or to prominently display particular products. This has given rise to so-called wall systems having provisions for removable and replaceable panels and provisions for selectively mounting projecting support arms. Typical prior art wall systems are disclosed in U.S. Pat. No. 3,719,014 issued Mar. 6, 1973 to R. D. Sukolics for a "Wall System" and U.S. Pat. No. 4,370,838 issued Feb. 1, 1983 to E. F. Vermillion for a "Curtain Wall."

With prior art wall systems, installation thereof has usually required the services of skilled mechanics. This was especially true when the wall system was attached to a wavy wall or a badly out-of-plumb wall. In those instances where installation of prior art wall systems was relatively simple, these systems generally lacked versatility and adaptability. That is, prior art wall systems permitted display alterations only with great effort, and often they did not have saw-tooth or wing sections and/or did not provide a finished look.

As will hereinafter be seen, in accordance with the instant invention, the foregoing limitations and/or difficulties associated with prior art wall systems are eliminated by constructing a main grid that consists of horizontal support channels that are secured directly to a wall and vertical standards that are secured to the fronts of the channels. The horizontal support channels are of generally U-shaped cross-section and have outwardly flaring ears at the rear thereof, while the standards are connected to the web at the front of the channel. Each web is provided with equally spaced apertures disposed at a longitudinal row and in one embodiment of this invention each standard is provided with holes that are equally spaced and are disposed in two vertical rows. These rows are spaced apart by the distance between adjacent apertures in the web of the channel so that by securing a standard to a channel, these elements automatically cross at right angles.

In constructing the grid, the first support channel that is mounted to the wall must be straight and horizontal and its web must lie in a vertical plane. Thereafter, standards are secured to the web of the first channel and as the former are secured they are automatically located in a single vertical plane. Additional channels are then slipped behind the standards and are secured thereto so as to be parallel to the first channel. This assures that all of the channels lie in a single plane. Spaces between these additional channels and the supporting wall are taken up by shims that are located at points where these channels are attached to the wall, and then these channels are secured to the supporting wall.

The arms of the main channel diverge slightly in the direction away from the connecting web. This permits nesting of one channel member with another channel member to facilitate the construction of auxiliary wall sections such as a wing or saw-tooth. That is, to construct an auxiliary wall section, the arms of a channel section are notched at predetermined locations to permit bending of the channel section web at locations defined by the notches. The channel is bent into a mounting section and a panel supporting section which are at a predetermined angle with respect to each other. The mounting section is telescoped over one of the main channel sections that is secured to the mounting wall and the supporting section is positioned at a predetermined angle with respect to this main channel. One or more additional supporting sections are formed in the channel member having the original supporting section and finally another mounting section is formed at the end of this channel member remote from the other mounting section. When necessary, cross-bracing is provided between one or more of the mounting sections and the main channel section that is secured to the wall.

SUMMARY OF THE INVENTION

Accordingly, the primary object of the instant invention is to provide a novel flexible and readily adaptable wall system constructed of relatively inexpensive components.

Another object is to provide a wall system of this type that is relatively simple to install.

Still another object is to provide a wall system of this type that may be installed by a relatively unskilled mechanic.

A further object is to provide a wall system of this type that is adapted to mount panels of different thicknesses of various materials, and utilizes blind fastening means to releasably mount such panels.

A still further object is provide a wall system of this type in which the construction of self-supported saw-toothed and other auxiliary wall sections is simplified.

BRIEF DESCRIPTION OF THE DRAWINGS

These objects as well as other objects of this invention shall become readily apparent after reading the following description of the accompanying drawings in which:

FIG. 3 is a cross-section taken through line 3—3 of FIG. 1 looking in the direction of arrows 3—3.

FIG. 8 is a fragmentary perspective of a bottom channel.

FIG. 8A is a front elevation of the bottom channel of FIG. 8 looking in the direction of arrows 8A—8A.

FIG. 9 is a fragmentary perspective of a main support channel.

FIG. 9A is a front elevation of the main support channel of FIG. 9 looking in the direction of arrows 9A—9A.

FIG. 12 is a fragmentary perspective of a panel divider strip.

FIG. 13 is a fragmentary perspective of a panel sub-support channel.

FIG. 18 is a fragmentary plan view of an interior corner.

FIGS. 20A and 20B are fragmentary perspectives of two different outside corner trim strips.

DETAILED DESCRIPTION OF THE PREFERRED EMBODIMENTS

Figure 1:
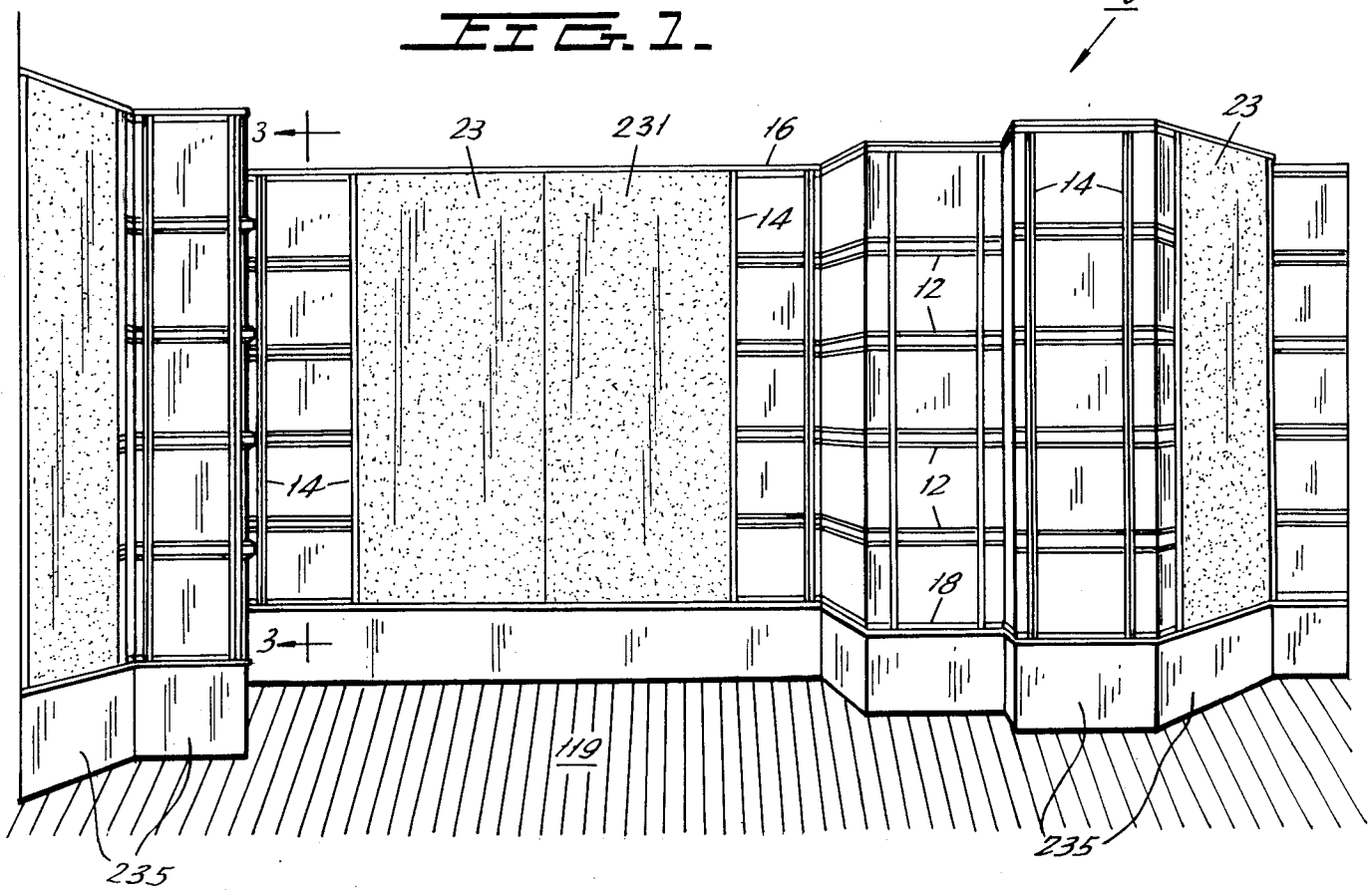
FIG. 1 is a perspective looking at the front of a wall system constructed in accordance with teachings of the instant invention, with most of the wall panels removed to reveal the supporting grid work.

Wall system 10 of FIG. 1 is constructed of a plurality of spaced horizontal main support channels 12 secured directly to wall 11 (FIG. 2), and a plurality of spaced main vertical members or standards 14 secured to the fronts of main channels 12. Top channel 16 caps the upper ends of standards 14 and bottom channel 18 caps the lower ends of standards 14. As will be explained hereinafter, these elements are connected to one another to form a main grid. This grid is used to removably support decorative panels 23 and/or arm elements (not shown), as well as other decorative displays and/or structural elements. As will also be seen hereinafter, panel divider channels or standards 80 (FIG. 12) are used instead of standards 14 at interior corners and panel sub-support channels or standards 90 (FIG. 13) are utilized instead of standards 14 at the center of a relatively wide panel and at exterior corners. Standards 80 and 90 may also be utilized when there is no requirement that a standard be provided with arm mounting slots 44.

Each main support channel 12 (FIGS. 9 and 9A) is an elongated element formed from galvanized steel sheets or the like to have a generally U-shaped cross-section consisting of arms 31, 32 that extend rearward from opposite ends of web 33. Ears 34, 35 extend outward from the rear ends of the respective arms 31, 32 and lie in a common plane. For reasons to be hereinafter seen, extending through web 33 are a plurality of locating apertures 36 that are equally spaced and are disposed in a longitudinally extending line located midway between the side edges of web 33. Each ear 34, 35 is provided with a series of clearance apertures 37. Fasteners (not shown) for securing main support channels 12 to wall 11 extend through as many of the clearance apertures 37 as is necessary.

Figure 5:
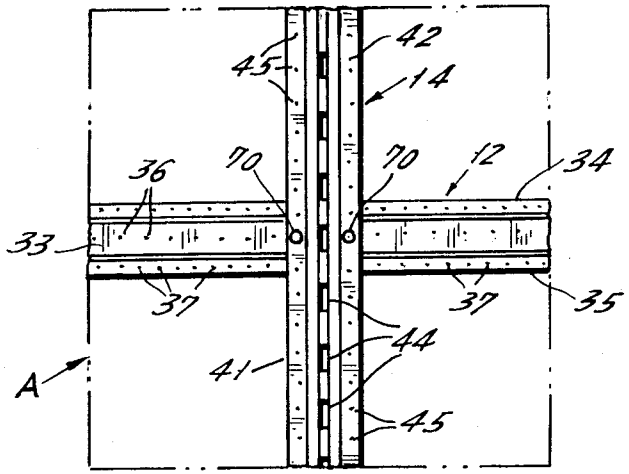
FIG. 5 is an enlargement of the area enclosed by rectangle A in FIG. 4.
Figure 15:
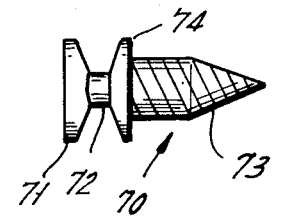
FIG. 15 is a side elevation of a fastener used for the removable mounting of a panel.
Figure 10A:
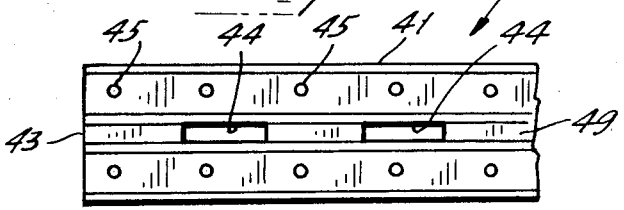
FIG. 10A is a front elevation of the standard of FIG. 10 looking in the direction of arrows 10A—10A.
Figure 10:
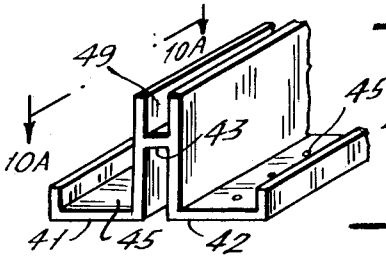
FIG. 10 is a fragmentary perspective of a standard.

Standard 14 (FIGS. 10 and 10A) for mounting a panel 23 and for mounting forwardly projecting arms (not shown), is an elongated extruded member which includes side-by-side parallel channels 41, 42 having arms of unequal height with the taller arms being closely spaced by recessed rib 43 that extends across central slot 49. Rib 43 is provided with equally spaced slots 44 for the mounting of forwardly extending support arms (not shown) of a type known to the art. The web or rear wall portion of each channel 41, 42 is provided with a plurality of equally spaced holes 45 located along a line parallel to the longitudinal axis of standard 14. The spacing between hole 45 in channel 41 and the adjacent hole 45 in channel 42 is equal to the spacing between locating apertures 36 and the line connecting these two adjacent apertures 45, 45 is perpendicular to the longitudinal axis of standard 14 so that standard 14 and main support channel 12 are disposed at right angles when connected to one another by dual functional screw fasteners 70, 70 (FIGS. 5 and 15).

Figure 7A:
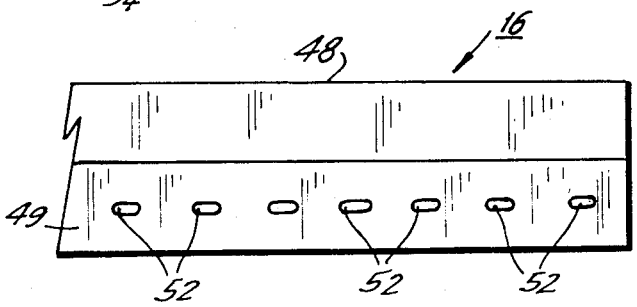
FIG. 7A is a front elevation of the top channel of FIG. 7 looking in the direction of arrows 7A—7A.
Figure 7:
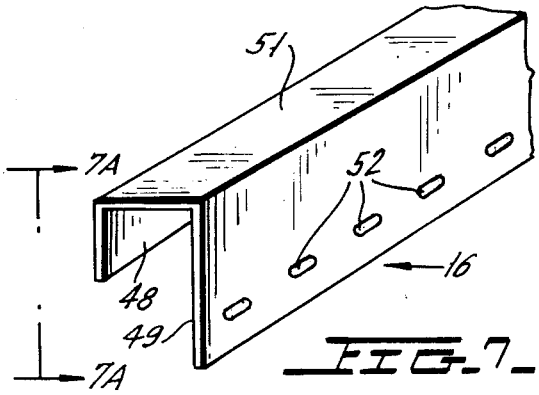
FIG. 7 is a fragmentary perspective of a top channel.

Top channel 16 (FIGS. 7 and 7A) is an elongated sheet formed member having relatively short front arm 48 and relatively long rear arm 49 that extend downward from opposite edges of top face 51. A plurality of horizontally elongated apertures 52 in arm 49 are disposed below arm 48 and are equally spaced in a row that is parallel to the longitudinal axis of top channel 16. The center-to-center spacing between adjacent apertures 52 is equal to the spacing between adjacent locating apertures 36 in main support channel 12 so that two adjacent apertures 52 may be aligned with apertures 45, 45 in opposite rows of standard 14 for securement of top channel 16 to standard 14 by screws 47.

Bottom channel (FIGS. 8 and 8A) is an extruded elongated double channel having front wall 51, intermediate wall 52 and rear wall 53 that extend upward from bottom wall 54. Uniformly spaced horizontally elongated apertures 56 in intermediate wall 52 are disposed in a longitudinal row 56 located above front arm 51. The center-to-center spacing between adjacent apertures 56 equals the spacing between adjacent locating apertures 36 in main support channel 12. Screws 47 extending through apertures 45 in opposite rows of standard 10 and through adjacent apertures 56 in bottom channel 18 secure the latter to standard 14 with rear wall 53 abutting permanent wall 11 and intermediate wall 52 lying adjacent the rear of standard 12.

Figure 14:
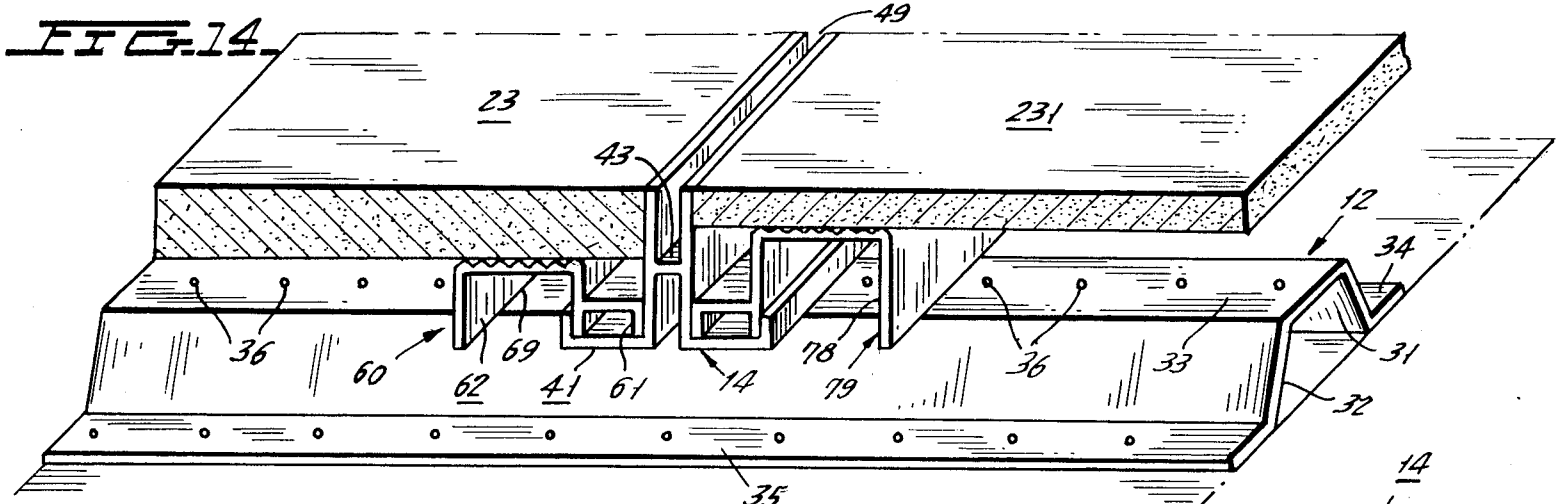
FIG. 14 is a fragmentary perspective illustrating the manner in which panels of different thicknesses are mounted adjacent to one another with their front surfaces lying in a common plane.
Figure 11A:
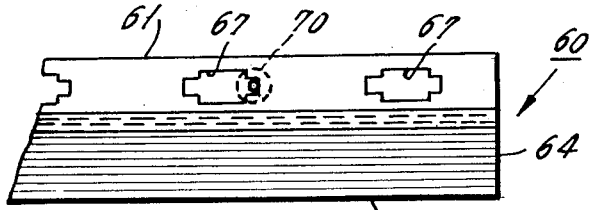
FIG. 11A is a front elevation of the panel support channel of FIG. 11 looking in the direction of arrows 11A—11A.
Figure 11:
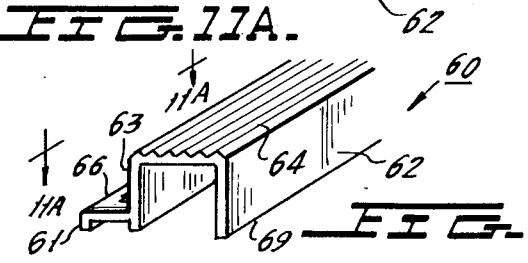
FIG. 11 is a fragmentary perspective of a panel support channel.

Panels, such as panels 23 and 123 of FIG. 14, are removably mounted to the main grid constructed of criss-crossed main support channels 12 and standards 14 by utilizing panel support channels 60 (FIGS. 11 and 11A). Each of the latter is an elongated extruded member forming side-by-side relatively short channel 61 and relatively tall channel 62 that share intermediate wall 63. The front wall or web 64 of tall channel 62 is striated to provide pockets for adhesive that bonds channel 60 to the rear of panel 23. Web 66 of short section 61 is positioned to the rear of web 64 and is provided with a plurality of equally spaced elongated apertures or double key-hole slots 67 formed with relatively wide intermediate sections and relatively narrow sections at each end thereof. The central section of aperture 67 is large enough to receive head 71 of screw fastener 70 (FIG. 15) and the relatively narrow end sections of aperture 67 are wide enough to receive narrow body extension 72 of combination fastener 70 but are not large enough to receive head 71. At locations where a panel 23 is to be secured to the main grid, main support channels 12 and standards 14 and/or panel divider strips 80 (FIG. 12) and/or panel sub-support channels 90 (FIG. 13) are secured together by threaded portions 73 of fasteners 70. In the case of a standard 14, enlargements 74 at the front of threaded portions 73 are adjacent the front surface of webs 41 and 42 of standard 14.

As seen in FIG. 14, channel section 61 is fitted into channel section 41. This is accomplished by inserting heads 71 through the enlarged portions of apertures 67 and then sliding channel 60 downward until connecting portion 72 of fastener 70 is at the upper narrow portion of aperture 67. Now channel 60 is locked against forward movement with respect to standard 14. Free edge 69 at the outer wall of tall channel 62 extends more rearward than any portion of short channel 61 to lie adjacent web 33. Striated surface 64 is then covered with cement and panel 23 is pressed thereagainst while the bottom edge thereof rests against the inner surface of bottom channel 18. Panel 23 is held in this position until panel support channel 60 is firmly secured thereto. In this position the right edge of panel 23 abuts the taller wall of channel 41. In the alternative, support channels 60 may be secured to the rear of panel 23 by mechanical fasteners (not shown).

It should now be clear to those skilled in the art that another panel support channel 60 is secured in mirror image position to panel 23 at the left edge thereof. To dismount panel 23 from the main grid of standards 14 connected to support channels 12, panel 23 is moved upward until the enlarged portions of apertures 67 are aligned with fastener heads 71. Panel 23 is then moved outward to disengage channels 60 from fasteners 70. Thereafter, channel 23 is raised as far as permitted by top channel 16. In this position, the bottom edge of panel 23 clears front wall 51 of bottom channel 18 and the bottom of channel 23 is tilted forward until channels 60 that are secured to the rear of channel 23 are forward of bottom channel 18, after which panel 23 is moved downward until its upper edge is below front wall 48 of top channel 60.

Panel 231 is not as thick as panel 23, yet the front faces lie in a common plane. This is accomplished by mounting panel 231 with panel support channels 79 rather than panel support channels 60. The only difference between channels 60 and 79 is that tall channel section 78 of the latter is taller than tall channel section 62 of panel support channel 60.

Figure 4:
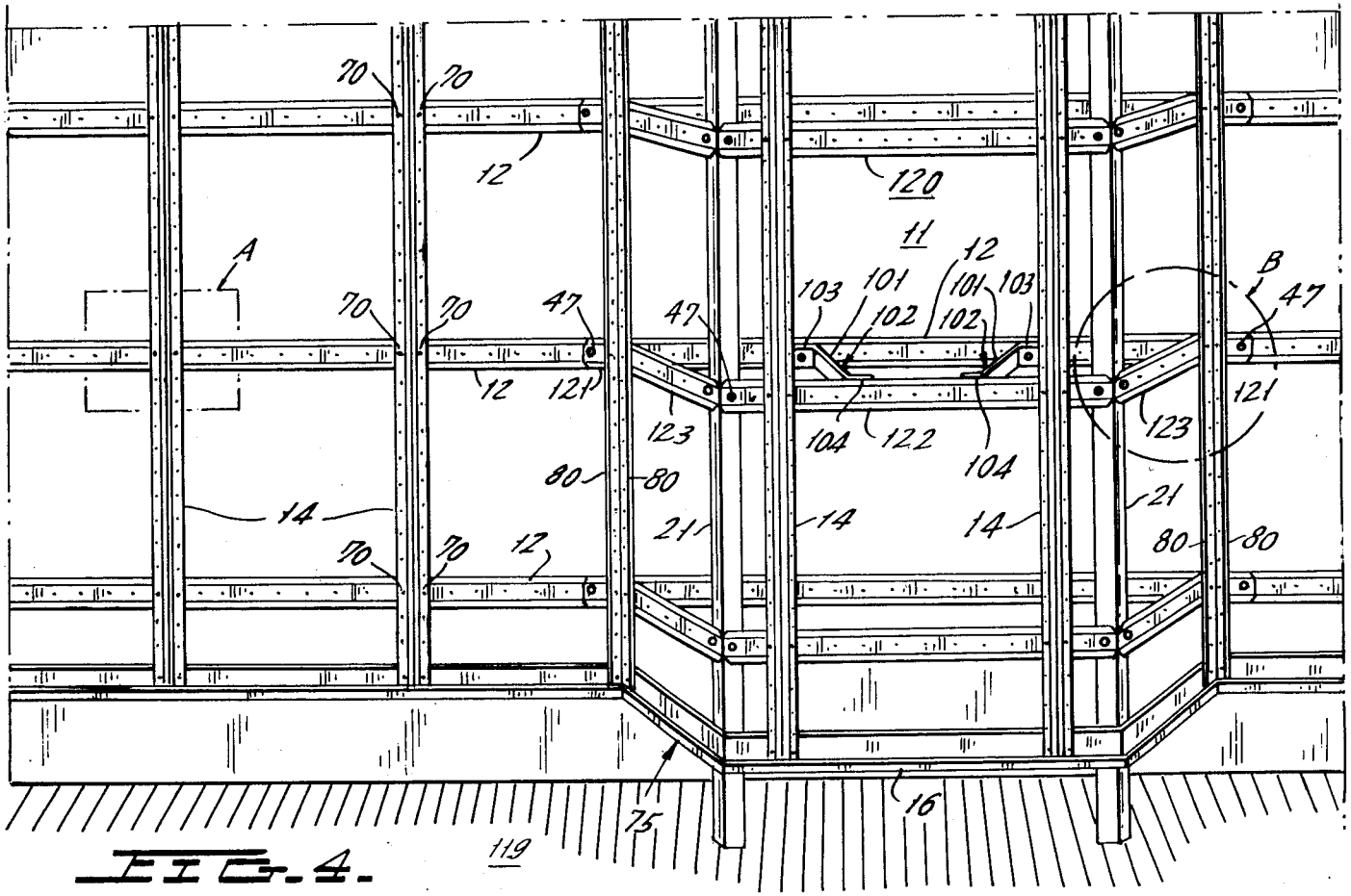
FIG. 4 is a fragmentary perspective showing an enlargement of an auxiliary grid section constructed in accordance with the teachings of the instant invention.
Figure 16:
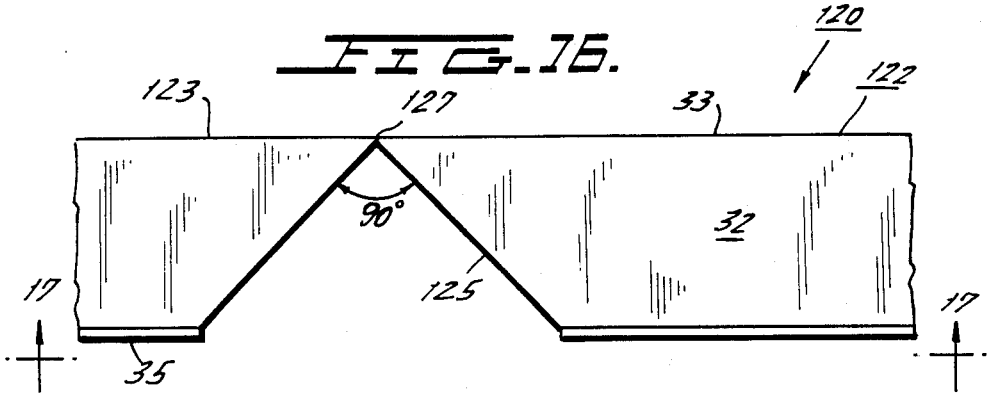
FIG. 16 is a side elevation of a main support channel that has been notched for bending.
Figure 17:
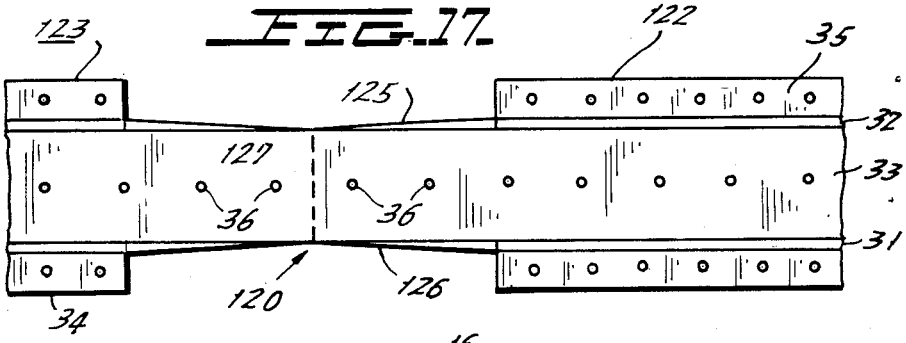
FIG. 17 is a rear elevation of the main support channel of FIG. 16 looking in the direction of arrows 17—17.

To construct an auxiliary wall section such as wing 75 of FIG. 4, an auxiliary grid is secured to the straight channels 12 that are mounted directly to wall 11. This auxiliary grid comprises a plurality of support channels 120 that are formed from a predetermined length of the same material that support channels 12 are constructed of. Each channel 120 includes a supporting section 121 at each end thereof, and central panel supporting section 122 that is illustrated as being parallel to wall 11 and offset forwardly therefrom by angled panel supporting sections 123 that connect opposite ends of central section 122 with end sections 121. Sections 121, 122 and 123 are connected at bend lines in web 33. Bending of member 120 is done conveniently by forming V notches 125 (FIG. 16) at predetermined locations of arm 32 in member 120 and by forming identical V notches 126 in arm 31 of memeber 120. Notches 125 and 126 are aligned, are of the same size and have an included angle of slightly more than 90°. The apices of notches 125, 126 locate bend line 127 which extends at right angles to a line that extends through locating apertures 36 and is midway between two adjacent apertures 36. By making notches 125, 126 slightly more than 90°, the included angle between central mounting section 122 and each of the outer mounting sections 123 may be as little as 90°.

As seen in FIG. 9, arms 31, 32 diverge slightly away from web 33. This permits supporting section 121 to be capped over main support channel 12 without appreciably increasing the thickness of the material that is mounted directly to wall 11. Naturally, to permit bending at line 127, those portions of ears 34, 35 that are aligned with notches 125, 126 must also be cut away.

For convenience, the angled cuts or lines defining notches 125, 126 may be made at a factory but the section of material bounded by notches 125 and 126 is not removed until the element constituting member 120 is ready for installation in the field. During shipping, ears 34, 35 remain in tact to maintain the strength of member 120. The provision of notches 125, 126 permits the convenient formation of both interior and exterior corners, but interior corners may be formed by using only straight cuts in arms 31, 32 and ears 34, 35.

The weight of auxiliary wall sections 75 and goods displayed thereon is taken up in large measure by having the lower ends of angle irons 21, 21 rest directly upon floor 119. Auxiliary wall section 75 is stabilized by utilizing one or more cross-braces 101 constructed of V-notched material that is the same as that of straight channels 12. Each cross-brace 101 has end sections 103, 104 that extend in opposite directions from central section 102 and are secured to channel 12 and section 122, respectively.

Figure 2:
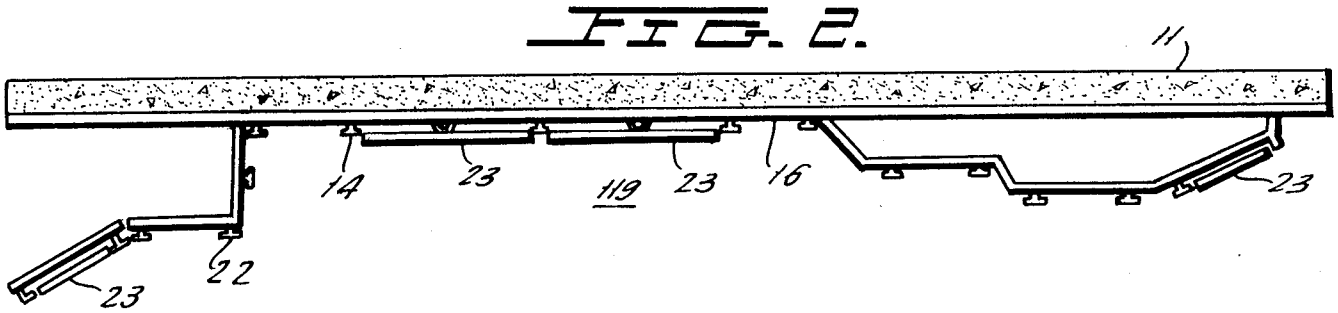
FIG. 2 is a plan view, in schematic form, of the wall system of FIG. 1.
Figure 6:
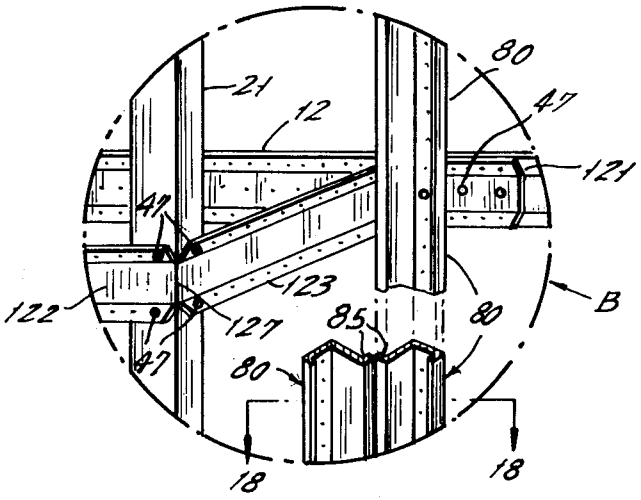
FIG. 6 is an enlargement of the area enclosed by circle B in FIG. 4.

By utilizing the techniques described in connection with construction of wing 75, auxiliary wall sections of different shapes, such as those illustrated in FIGS. 1 and 2 as well as other shapes including a saw-tooth auxiliary wall section, may be constructed. It is noted that each of the vertical elements 14, 80, 90 is a modified channel that is capable of receiving a panel support channel 60.

Wall system 10 is constructed by marking a vertical center line and a horizontal level line on wall 11. The latter line is in the vicinity of a point that will be approximately halfway between upper and lower caps 16, 18. A first main support channel 12 is installed along the level line by attaching this first channel 12 loosely to the front of wall 11 in a position such that the vertical center line is half-way between adjacent apertures 36 of channel 12. This is accomplished by utilizing fasteners (not shown) that are driven into wall 11 through apertures 37 in arms 34, 35. Shims may be utilized to maintain ears 34, 35 of first channel 12 in a common vertical plane. When splicing main support channels in axial alignment, a piece of main channel material 12 approximately one foot long should overlap equally the ends adjacent main support channels 12, 12 in which the spacing between adjacent apertures 36 is between one and two inches.

Standards 14, 80 and/or 90, as the case may be, are attached to this first channel 12 at appropriate locations therealong. This fastening is accomplished by utilizing fasteners 70 of FIG. 13. Before securing standards 14, 80, 90 to the first main support channel 12, these standards 14, 80, 90 are cut to appropriate length. Additional horizontal runs of main support channels 12 are then slipped behind standards 14, 80, 90 and are secured thereto in spaced relationship to the first main support channel 12. The butt joints between axially aligned channels 12 should be staggered. That is, the butt joints in a horizontal run of channels 12 should be horizontally offset from the butt joints in alignment runs of channels 12. If wall 11 is provided with inside or outside corners, each run of main support channels 12 should have appropriately located bend notches 125, 126.

Thereafter, the first main support channel 12 is fixedly secured to wall 11 by fasteners (not shown) that are driven through apertures 37. After the plumb condition of standards 14, 80, 90 is checked, the other main support channels 12 are shimmed and secured to wall 11.

Thereafter, appropriate elements are secured to the main grid for one or more auxiliary wall sections, such as wing 75 of FIG. 4. Panels 23, 123, etc , are then mounted as previously described in connection with FIGS. 11, 11A and 14, and hooks (not shown) are engaged in selected apertures 44 of standards 14. If desired, panels 235 may be installed below the section of bottom channel 18, especially at auxiliary wall sections such as wing 75.

Panel divider channel or standard 80 (FIG. 12) is an elongated extruded member defining a channel having short arm 81 and long arm 82 that extend forward from web 83. The latter is provided with a plurality of holes 84 located along a line parallel to the longitudinal axis of standard 80. Holes 84 are equally spaced by a distance equal to that between apertures 36 of main support channel 12. Standard 80 is secured to the front of main channels 12 by fasteners 70 which extend through holes 84. These fasteners 70 then removably engage a panel support channel 60 or 79 whose shallow channel is disposed between arms 81, 82. The forward free end of long arm 82 is provided with outward and sideways extension 85 whose forward surface is polished and is positioned to be generally flush with the outer surface of panel 23 to form an attractive panel divider strip. The total width of standard 80 is half the width of standard 14. FIG. 18 illustrates two standards 80 in an inside corner configuration with the outside edges of their sideways extensions 85 being adjacent to each other.

As will become apparent, an inside corner may also be formed by replacing standards 80 by standards 90 (FIG. 13) and having the edge of one corner panel 123 butt the exterior face of the other corner panel 123.

Panel sub-support channel or standard 90 (FIG. 13) is an elongated extruded member defining a shallow channel having a pair of arms 91, 91 that extend forward from the opposite ends of web 92. The latter is provided with a plurality of equally spaced holes 93 located along a line parallel to the longitudinal axis of standard 90. The spacings between adjacent holes 93 equals the spacing between adjacent apertures 36 of main support channel 12. Holes 93 receive fasteners 70 that secure standard 90 to the front of main channel 12. Arms 91 are generally the same height as the short arms of standard 14 and are spaced apart so as to receive the shallow channel of support channel 79, as seen in the exterior corner configuration of FIG. 19.

Figure 19:
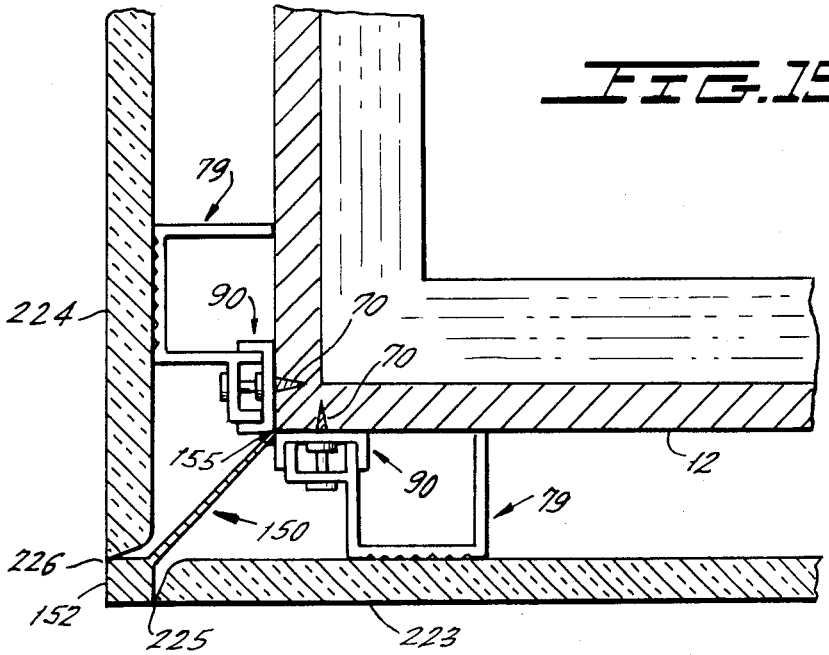
FIG. 19 is a fragmentary plan view of an exterior corner.

More particularly, in FIG. 19 two panel subsupport channels or standards 90 are shown secured by fasteners 70 to different legs of a horizontal main channel 12 with such legs being at right angles to one another. The rear edges of these channels 90 are positioned close to each other to define an interior corner for receiving rear edge 151 of trim strip 150 whose forward edge is provided with enlarged nose 152 whose forward surfaces are polished for decorative purposes. Longitudinal striations 153 permit rear portions of strip 15 to be broken away for adjusting the width thereof. The adjusted width of strip 15 is dictated by the angle of the inside corner installations.

Panel support channels 79, removably held on standards 90 by fasteners 70, are secured to the rear of two panels, in this case mirrors 223, 224, whose vertical corner edges are finished so as to be chamfered or crowned slightly. These finished edges are disposed adjacent the rear surfaces of nose 152.

To form the configuration of FIG. 19, panels 223, 224 are cemented to support channels 79, 79 with a predetermined space between panel edges 225, 226. This space is equal to the width of nose 152. The width of trim strip 150 is then adjusted to fit into the inside corner defined by standards 90, 90 while nose 152 is adjacent panel edges 225, 226. Preferably the outer surfaces of nose 152 will be coplanar with the exterior surfaces of panels 223, 224. Thereafter, one of the panels 223, 224 with its attached support channels 79, 79 is removed to provide access to the corner defined by standards 90, 90. A bead of cement 155 is then applied to that corner, the removed mirror panel is replaced, and rear edge 151 of trim strip 150 is inserted through the narrow space between panel edges 225, 226 and into cement bead 155. Curing of the bead firmly secures strip 150 to standards 90, 90 in the operative position shown in FIG. 19.

Exterior corner trim strip 160 of FIG. 20B is the same as trim strip 150 except that bead 152 of the latter replaced by a generally arcuate head 161 which is proportioned to overlap unfinished edge portions of corner forming panels on the outside thereof.

Certain of the corner areas in FIGS. 1 and 4 have been shown as being open merely for purposes of illustration. For finished walls, these corners will be covered in a suitable manner including the utilization of appropriate inside and/or outside trim pieces as in FIGS. 18 and 19.

Figure 21:
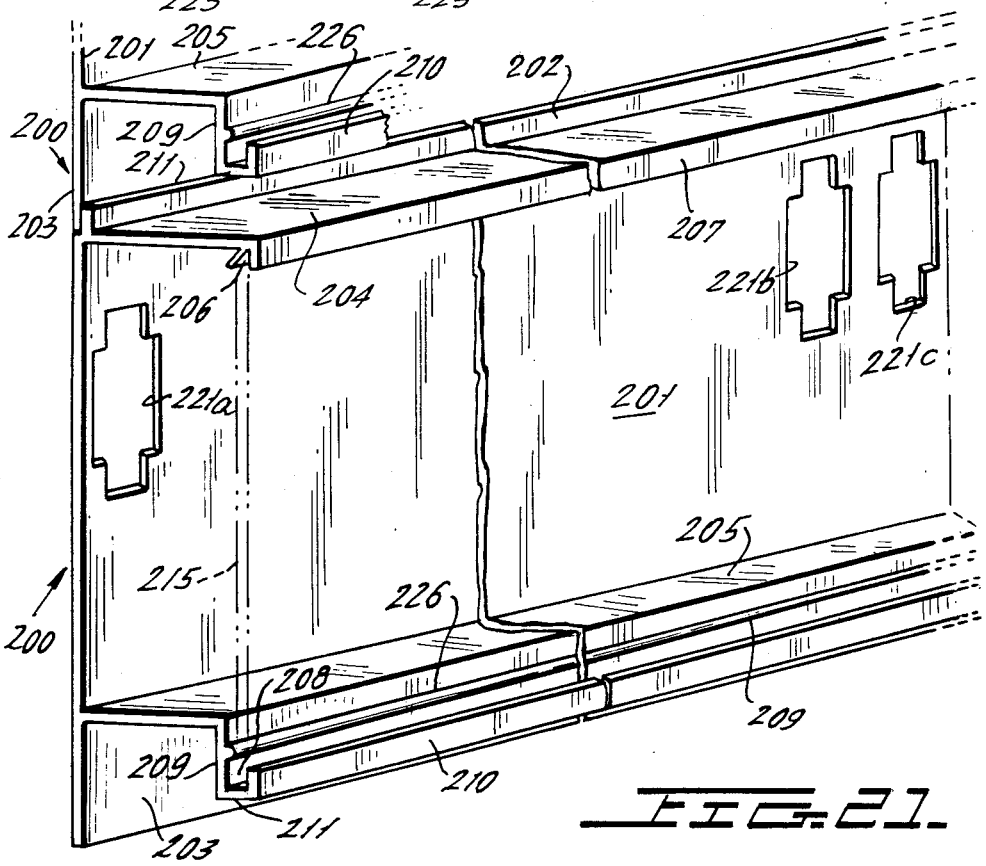
FIG. 21 is a fragmentary perspective of a support panel for a narrow horizontal decorative strip.

FIG. 21 illustrates a fragmentary portion of an extruded slat wall supporting element 200 that is adapted to be mounted horizontally and extend between two or more spaced shallow standards 90 while resting on the forward edges thereof and being held removable by fasteners (not shown) having the same general form as fasteners 70 with the neck 72 thereof extended so that outer head 71 is disposed slightly in front of the forward edges of standard 90. Supporting element 200 includes main sheet-like wall 201 having a plurality of double key slots 221*a, b, c,* etc., that are of the same size and shape as slots 67 in panel support members 60, 79, and cooperate with the extended version of fasteners 70 to removable mount element 200.

Typically, element 200 is 4 inches wide and 96 inches long and is intended to be cut to any desired length. Slots 221 are arranged in pairs except at each end of element 200 where there is a single slot 221. Slots 221*b* and 221*c* of a pair have a center-to-center spacing of one inch, there is an eleven inch center-to-center spacing between slots 221*a* and 221*b*, and there is a twelve inch center-to-center spacing between slots 221*c* and the slot (not shown) to the right thereof. This twelve inch spacing between slots repeats from one slot 221 in a pair to the corresponding slot 221 in the adjacent pair.

Upper edge 202 of wall 201 is stepped forward by the thickness of wall 201 to permit the bottom edge 203 of an adjacent higher element 200 to slip behind edge 202. Ribs 204, 205 extend forward from wall 201 and 226 in the vicinity of the respective edges 202, 203. Inverted generally V-shaped pocket 206 along the forward edge of rib 204 is partially defined by vertical lip 207 that extends downward from the first edge of rib 204. Generally U-shaped downwardly facing pocket 208 along the forward edge of rib 205 is connected thereto by downward extension 209 that provides one of the U-arms defining upwardly facing pocket 208. The other U-arm 210 is forward of extension 208, being connected thereto by web 211 and being coplanar with lip 207. Longitudinal rib 226 disposed slightly above arm 210 projects slightly from the front face of extension 209 to aid in positioning the bottom of panel 215 seated in pocket 208. When a plurality of elements 200 are stacked one above the other, web 211 of one element 200 is close to rib 204 of the adjacent lower element 200. For decorative purposes, the exposed front surfaces of lip 207 and arm 210 are polished. Pockets 206 and 208 are disposed and shaped to receive and hold the respective upper and lower edges of decorative slat 215 that is constructed of thin resilient sheet material such as aluminum, formica, thick paper, and the like.

It should be appreciated by those skilled in the art that the channels and main support members described may, for the most part, be constructed of metal or plastic, depending upon strength and cost considerations.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. A wall system including a main grid and at least one panel supported on said grid at the front thereof;

said grid including a plurality of parallel main channel members and a plurality of parallel standards extending transverse to said channel members;

each of said channel members having a generally U-shaped transverse cross-section that includes a web, first and second arms each having a front end and a rear end, said arms at their said front ends being connected to said web and extending rearward from opposite ends thereof, and first and second ears projecting in opposite directions from the rear ends of the respective first and second arms;

said standards being secured to said webs and being disposed forward thereof;

means having cooperating sections on said standards and said at least one panel removably securing the latter to the standards;

said ears forming longitudinally extending coplanar mounting ledges adapted for securement to a wall;

said web being provided with a plurality of locating apertures disposed in a longitudinally extending row with a predetermined spacing therebetween;

each of said standards having first and second longitudinally extending rows of holes, said rows being spaced apart by a distance equal to said predetermined spacing between said apertures;

first and second securing elements for securing a first of said standards to a first of said channel members;

said first securing element extending through a first of said apertures and a hole in said first row, and said second securing element extending through a second of said apertures and a hole in said second row.

2. A wall system as set forth in claim 1 in which the arms diverge in a rearward direction.

3. A wall system as set forth in claim 1 in which the channel members extend horizontally and the standards extend vertically.

4. A wall system as set forth in claim 3 also including an auxiliary grid angularly disposed with respect to said main grid; said auxiliary grid including a plurality of vertically spaced horizontal auxiliary channel members and another plurality of vertical standards secured to said auxiliary channel members; said main and auxiliary channel members being of like cross-section; each of said auxiliary channel members including a mounting section and a supporting section formed integrally with said mounting section and connected thereto in end to end relationship at a transverse bend line in said web; said mounting section telescoping over a main channel member and being secured directly thereto; said supporting section and said mounting section having a predetermined angle therebetween; said another plurality of vertical standards being secured to said supporting section.

5. A wall system as set forth in claim 4 in which each of said auxiliary channel members also includes another mounting section at one end thereof and said mounting section at the other end thereof; said another mounting section also telescoping over a main channel member and being secured directly thereto.

6. A wall system as set forth in claim 4 in which for each of said auxiliary channel members, prior to bending thereof at said bend line, having the mounting and supporting sections thereof in axial alignment, with each of said diverging arms of said auxiliary channel member having a V-notch therein; said bend line extending between the apices of said V-notches.

7. A wall system as set forth in claim 6 in which prior to bending of said auxiliary channel members each of said V-notches defines an included angle of approximately 90°.

8. A wall system as set forth in claim 3 in which each of said standards, in transverse cross-section, includes a rear wall, first and second short arms extending forward from said rear wall at opposite ends thereof, first and second long arms extending forward from said rear wall; said long arms being spaced slightly to form a narrow slot therebetween that is centered between said short arms; said first and second rows of holes being in said rear wall with said first row being located between said first short arm and said slot and said second row being located between said second short arm and said slot.

9. A wall system as set forth in claim 8 in which said rear wall is provided with spaced elongated apertures aligned with said slot and adapted to receive locking formations of mounting brackets that extend through the slot, are stabilized by said long arms and project forward thereof.

10. A wall system as set forth in claim 1 in which the first and second apertures are adjacent to each other.

11. A wall system including a main grid and at least one panel supported on said grid at the front thereof;

said grid including a plurality of parallel main channel members and a plurality of parallel standards extending transverse to said channel members;

each of said channel members having a generally U-shaped transverse cross-section that includes a web, first and second arms each having a front end and a rear end, said arms at their said front ends being connected to said web and extending rearward from opposite ends of said web, said first and second ears projecting in opposite directions from the rear ends of the respective first and second arms;

said standards being secured to said webs and being disposed forward thereof;

means having cooperating sections on said standards and said at least one panel removably securing the latter to the standards;

said ears forming longitudinally extending coplanar mounting lengths adapted for securement to a wall;

a first set of said cooperating sections including a shaft, a head on said shaft at the front thereof and a transverse projection on said shaft disposed a predetermined distance to the rear of said head;

said projection limiting rearward movement of said shaft with respect to a first of said standards to which said first cooperating section is mounted;

said cooperating sections including a slot formation in holding means secured to said at least one panel at the rear thereof;

said slot formation including an enlarged section through which said head is extendable and a reduced section too small to receive said head and through which a shaft portion extends; and said shaft portion being disposed between said head and said projection.

12. A wall system as set forth in claim 11 in which the holding means includes side-by-side rearwardly facing first and second channel sections extending parallel to said standards; said first channel section including a first web section secured directly to said panel to which said holding means is secured; said second channel sections being shorter than said first channel section and includes a second said section disposed rearward of said first web section; said slot formations being in said second web section and said head being disposed forward of said second web section.

13. A wall system as set forth in claim 12 in which said channel sections share a common arm and said first channel section includes another arm that extends more rearward than said common arm to lie adjacent said web of the main channel to which said first standard is mounted.

14. An elongated main channel member for constructing a wall system;

said channel member having a generally U-shaped transverse cross-section that includes a web, first and second arms each having a front end and a rear end, said arms extending rearward from opposite ends of said web, and first and second ears projecting in opposite directions from the rear ends of the respective first and second arms;

said ears forming longitudinally extending coplanar mounting ledges adapted for securement to a wall; arms diverging in a rearward direction;

said web being provided with a plurality of locating apertures disposed in a longitudinally extending row with a predetermined spacing therebetween; said main channel member also including a mounting section and a supporting section connected end to end at a transverse bend line in said web located midway between adjacent first and second of said locating apertures.

15. A main channel member as set forth in claim 14 in which said auxiliary channel member also includes another mounting section at one end thereof and said mounting section at the other end thereof.

16. A main channel member as set forth in claim 15 in which said channel member, prior to bending thereof at said bend line, having the mounting and supporting sections thereof in axial alignment, with each of said diverging arms of said channel member having a V-notch therein; said bend line extending between the apieces of said V-notches.

17. A main channel member as set forth in claim 14 in which prior to bending of said channel member each of said V-notches defines an included angle of approximately 90°.

18. A main channel member as set forth in claim 14 wherein prior to installation thereof said ears are unbroken for the length of said channel member to rigidify the latter during shipping thereof.

19. A construction element comprising:

an elongated channel having a generally U-shaped cross-section that includes a web, first and second arms each having a front end and rear end, said arms at their front ends being connected to said web and extending rearward from opposite ends of said web, and first and second ears projecting in opposite directions from the rear ends of the respective first and second arms;

said channel being bent to define integrally formed first and second sections that are angularly disposed with respect to each other and connected in end to end relation at a transverse bend line in said web;

said channel prior to bending thereof at said bend line having said first and second sections in axial alignment;

prior to bending of said channel at said bend line, said first and second arms each having a V-notch therein and said bend line extending between the apices of said V-notches.

20. A construction element as set forth in claim 19 in which prior to bending of said channel member, each of said V-notches defines an included angle of approximately 90°.

21. A construction element as set forth in claim 19 in which said arms diverge in a rearward direction.

22. A construction element as set forth in claim 19 in which the channel is also bent to define a third section integrally formed with said first and second sections;

said second and third sections being angularly disposed with respect to one another and connected in end to end relation at another transverse bend line in said web;

said channel prior to bending thereof at said another bend line having said second and third sections in axial alignment;

prior to bending of said channel member to define said third section, said first and second arms having additional V-notches therein and said another bend line extending between the apices of said additional notches.

23. A construction element as set forth in claim 22 in which the bend lines are parallel.

24. A construction element as set forth in claim 22 in which prior to bending of said channel member, each of said V-notches and said additional V-notches defines an included angle of approximately 90°.

25. A construction element as set forth in claim 22 in which said arms diverge in a rearward direction.

26. A frame-like assembly of construction elements comprising at least three elongated channels having identical U-shaped cross-sections;

(a) each of said channels including:

(i) a web, first and second arms each having a front end and a rear end, said arms at their front ends being connected to said web and extending rearward from opposite ends of said web, and first and second ears projecting in opposite directions from the rear ends of the respective first and second arms;

(ii) said channel being bent to define integrally formed first and second sections that are angularly disposed with respect to each other and connected in end to end relation at a transverse bend line in said web;

(iii) said channel prior to bending thereof at said bend line having said first and second sections in axial alignment;

(iv) prior to bending of said channel at said bend line, said first and second arms each having a V-notch therein and said bend line extending between the apices of said V-notches.

(b) each of said channels also being bent to define:

(i) a third section integrally formed with said first and second sections:

(ii) said second and third sections being angularly disposed with respect to one another and connected in end to end relation at another transverse bend line in said web;

(iii) said channel prior to bending thereof at said another bend line having said second and third sections in axial alignment;

(iv) prior to bending of said channel to define said third section, said first and second arms having additional V-notches therein and said another bend line extending between the apieces of said additional notches;

(c) said first sections being of equal lengths, said second sections being of equal lengths, and said third sections being of equal lengths;

(d) and means maintaining said first sections in spaced parallel relationship, said second sections in spaced parallel relationship, and said third sections in spaced parallel relationship.

27. A construction element as set forth in claim 26 in which the bend lines are parallel.

28. A construction element as set forth in claim 27 in which prior to bending of said channel member, each of said V-notches and said additional V-notches defines an included angle of approximately 90°.

29. A construction element as set forth in claim 26 in which said arms diverge in a rearward direction.

* * * * *